US008333562B2

(12) United States Patent
Asai et al.

(10) Patent No.: US 8,333,562 B2
(45) Date of Patent: Dec. 18, 2012

(54) LONG STEAM TURBINE ROTOR BLADE HAVING PARTICULAR COVER

(75) Inventors: Kunio Asai, Hitachi (JP); Takeshi Kudo, Hitachinaka (JP); Tateki Nakamura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 1351 days.

(21) Appl. No.: 11/867,389

(22) Filed: Oct. 4, 2007

(65) Prior Publication Data

US 2008/0175712 A1 Jul. 24, 2008

(30) Foreign Application Priority Data

Oct. 5, 2006 (JP) ..... 2006-273530

(51) Int. Cl.
*F01D 5/16* (2006.01)
*F01D 5/22* (2006.01)
*F01D 25/04* (2006.01)

(52) U.S. Cl. ..... 416/190; 416/191; 416/192; 416/195; 416/196 R

(58) Field of Classification Search ..... 416/189–192, 416/194, 195, 196 R, 228
See application file for complete search history.

(56) References Cited

U.S. PATENT DOCUMENTS

| | | | | |
|---|---|---|---|---|
| 4,840,539 | A | 6/1989 | Bourcier et al. | |
| 5,156,529 | A | 10/1992 | Ferleger et al. | |
| 5,261,785 | A | 11/1993 | Williams | |
| 6,341,941 | B1 * | 1/2002 | Namura et al. | 416/190 |

FOREIGN PATENT DOCUMENTS

| | | | |
|---|---|---|---|
| EP | 1 267 042 | | 12/2002 |
| EP | 1 707 742 | | 10/2006 |
| JP | 10030402 | A * | 2/1998 |
| JP | 10-317904 | | 12/1998 |
| JP | 11294102 | A * | 10/1999 |
| JP | 2004-169604 | | 6/2004 |
| JP | 2005-133543 | | 5/2005 |
| JP | 2006-9801 | | 1/2006 |

OTHER PUBLICATIONS

Machine Translation of JP10-30402 retrieved from PAJ on Feb. 29, 2011.*

Japanese Office Action in Japanese Application No. JP 2006-273530 mailed Dec. 2, 2010 (with partial English translation).

Search Report in European Patent Application No. 07019376.8-2321/1911935 dated Feb. 9, 2010.

Office Action dated Jul. 2, 2009 in corresponding Canadian Application No. 3,604,757.

* cited by examiner

*Primary Examiner* — Igor Kershteyn
*Assistant Examiner* — Jesse Prager
(74) *Attorney, Agent, or Firm* — Brundidge & Stanger, P.C.

(57) ABSTRACT

A steam turbine rotor blade has a profile and a cover integrally formed on and at an end of the profile, the leading edge of the cover formed on the profile and the trailing edge of a cover formed on an adjacent preceding profile being in contact and connected with each other by the torsional return force produced during rotation. The cover formed on the profile is provided with a radially-formed stepped portion at the trailing edge, the stepped portion having a height large than the thickness of the cover.

2 Claims, 6 Drawing Sheets

LONG STEAM TURBINE ROTOR BLADE HAVING PARTICULAR COVER

BACKGROUND OF THE INVENTION

1. Field of the Invention

The present invention relates to a steam turbine rotor blade in which blades are connected with one another by covers formed at respective ends thereof.

2. Description of the Related Art

Recent years have seen a demand for increasing the blade length in a low-pressure last stage of a steam turbine aiming at increasing the efficiency and capacity thereof. There is a tendency of increasing severity of requirements for the cover with increasing blade length.

With increasing blade length, the amount of torsion of the blade (hereinafter referred to as profile) also increases, and an angle formed between the camber line of the profile and the circumferential direction tends to decrease accordingly.

With a decrease in this angle, an area for forming a cover canopy decreases making it difficult to provide a sufficient contact length and rigidity.

Further, with increasing blade length, the amount of deformation caused by the centrifugal force also increases and accordingly does the variation in a cover gap. As a result, there arises a tendency of increasing part having a large cover gap. If the cover gap increases, the contact length decreases and a problem of degraded vibration characteristics arises. In the worst case, the covers may be disconnected.

JP-A-2006-009801 discloses an art that provides a stepped portion radially formed at the leading edge of the blade in order to prevent moisture from staying by virtually eliminating moisture trapping pockets.

SUMMARY OF THE INVENTION

With increasing length of a steam turbine rotor blade in recent years, requirements of the cover are expected to be severer in future.

It is not necessarily assumed that the related art has provided satisfactory solutions for subjects caused by the increased length of the steam turbine rotor blade.

With the present invention, typical subjects caused by the increased length of the steam turbine rotor blade, i.e., the rigidity and vibration characteristics are discussed to prevent the reduction of rigidity and accordingly the degradation of vibration characteristics.

An object of the present invention is to provide a steam turbine rotor blade that has overcome these subjects.

A steam turbine rotor blade according to the present invention comprises a profile and a cover integrally formed on and at an end of the profile. The leading edge of the cover formed on the profile and the trailing edge of a cover formed on an adjacent preceding profile are in contact and connected with each other by the torsional return force produced during rotation.

The cover formed on the adjacent preceding profile is characterized by a radially-formed stepped portion at the trailing edge thereof, the stepped portion having a height larger than the thickness of the cover.

Further, preferably a canopy overhanging the back side of the profile is positioned at the stepped portion formed at the trailing edge of the cover formed on the adjacent preceding profile.

Further, preferably an angle formed between a contact line formed by the contact surface where adjacent two covers are in contact with each other and a circumferential line along which the adjacent two covers are connected is set to 30 to 50 degrees.

Further, when P denotes the intersection of the end of the leading edge of the cover formed on the profile and the camber line thereof, Q denotes the intersection of the end of the trailing edge of the cover formed on the adjacent preceding profile and the camber line thereof, and R denotes the intersection of a straight line connecting P and Q and the above-mentioned contact line, it is desirable that a line segment ratio PR/PQ, a ratio of a segment PR to a segment PQ, be 0.6 to 0.8.

Further, preferably the profile has a length of 48 inches or more and further 52 inches or more.

Further, preferably the profile is used for the last stage of a low-pressure steam turbine.

Further, the steam turbine rotor blade according to the present invention comprises a profile and a cover formed on and at an end of the profile. The adjacent two covers are in contact with each other by the torsional return force produced during rotation. An angle formed between the contact line formed by the contact surface where the adjacent two covers are in contact with each other and the circumferential line along which the adjacent two covers are connected be set to 30 to 50 degrees. The cover disposed on the steam outlet side of the profile is provided with a radially-formed stepped portion having a height larger than the thickness of the above-mentioned cover.

With such a steam turbine rotor blade, preferably the canopy overhanging the back side on the steam inlet side of the profile is positioned at the stepped portion formed on the cover disposed on the steam outlet side of the adjacent preceding profile.

In accordance with the present invention, it is possible to prevent the reduction of rigidity caused by the increased length of the steam turbine rotor blade and the degradation of vibration characteristics.

BRIEF DESCRIPTION OF THE DRAWINGS

FIG. 1A is a bird's-eye view of a steam turbine rotor blade; FIG. 1B is a plan view as viewed radially from the outer circumference side; FIG. 1C is a detail view of circle A of FIG. 1B; and FIG. 1D is a perspective view as viewed in the direction of arrow B in FIG. 1C.

FIG. 2A is a plan view as viewed radially from the outer circumference side; FIG. 2B is a detail view of circle B of FIG. 2A, showing a condition at the time of assembly; and FIG. 2C is a detail view of circle B of FIG. 2A, showing a condition during rotation.

FIG. 5A shows a small θ (smaller than 30 degrees); FIG. 5B, a large θ (larger than 50 degrees); FIG. 5C, a contact angle of the present embodiment (30 to 50 degrees); and FIG. 5D, a case where a cover canopy is formed from the steam outlet end like FIG. 5B with a condition that θ is 30 to 50 degrees.

FIG. 6A shows a definition of each section for calculation; FIG. 6B is a bird's-eye view of a position where a large vibration stress occurs; FIG. 6C is a relation between the line segment ratio PR/PQ and a relative erosion depth at the point S; FIG. 6D is a relation between the line segment ratio PR/PQ and a vibration stress at the point S; and FIG. 6E is a relation between the line segment ratio PR/PQ and a local stress at the point T.

DETAILED DESCRIPTION OF THE PREFERRED EMBODIMENTS

First of all, a cover structure of a steam turbine rotor blade applied as a comparative example will be explained with reference to FIGS. 2A to 2C.

Figure 2A:
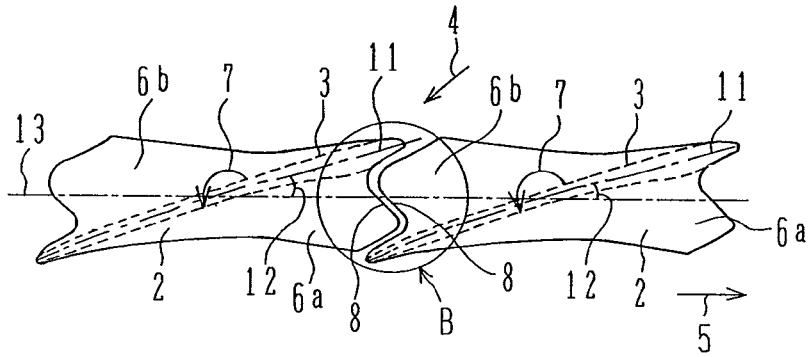
FIGS. 2A to 2C are diagrams showing a comparative example of the present invention.

Referring to FIG. 2A, canopies 6 respectively overhanging the back and front sides are formed on the cover 2 in association with the shape of a profile 3 at an end of the rotor blade.

A backside canopy 6*a* of the rotor blade and a foreside canopy 6*b* of the adjacent preceding rotor blade are structured so as to be in contact and connected with each other at a contact surface 8 by a torsional return force 7 caused by the centrifugal force during rotation.

Further, an angle formed between the camber line 11 of the profile 3 and a circumferential direction 13 is denoted by reference numeral 12.

Figure 2B:
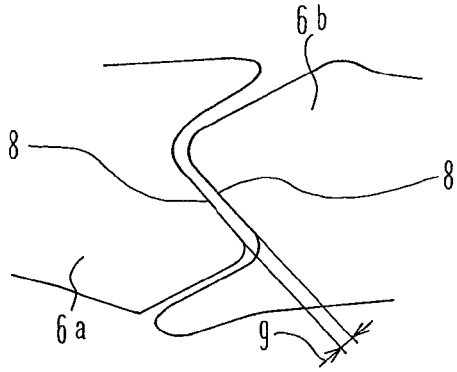

As shown in FIG. 2B, a cover gap 9 is provided in the normal direction between the contact surfaces 8 of the adjacent two rotor blades, and an appropriate amount of gap is defined to ensure a contact force of the covers required during rotation.

Figure 2C:
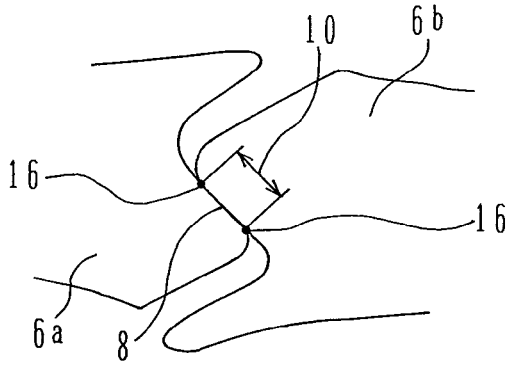

This allows provision of a contact length 10 over which the covers are in contact with each other during rotation, as shown in FIG. 2C. Here, reference numerals 16 denote contact ends.

In the case of a rotor blade having a length of 52 inches or more, for example, with increasing length of the steam turbine rotor blade, the amount of torsion of the profile also increases, and there arises a tendency of decreasing the angle 12 formed between the camber line 11 of the profile 3 and the circumferential direction 13. With a decrease in this angle 12, an area for forming the canopy 6 of the cover 2 decreases making it difficult to provide a sufficient contact length 10 and rigidity.

Further, with increasing amount of deformation caused by the centrifugal force, the variation in the cover gap 9 also increases, and there arises a tendency of increasing the part having a large cover gap 9. If the cover gap 9 increases, the contact length 10 decreases and a problem of degraded vibration characteristics arises. That is, even if part having a larger cover gap 9 is formed, it is necessary to provide a sufficient contact length 10 during rotation to maintain the full circumferential connection in the rotational direction 5.

Possible solutions for improving the resistance to fretting fatigue and abrasion of the contact surface 8 include increasing the thickness and rigidity of the cover 2. In this case, however, the centrifugal force of the rotor blade increases with increasing thickness of the cover 2. Therefore, in limit strength design accompanying the increased blade length, there has been a limit of allowable thickness of the cover 2.

Further, the vibration force is exerted on the steam turbine rotor blade in addition to the centrifugal force. Since there is a tendency of increasing vibration force exerted on the steam turbine rotor blade with the increased output in recent years, the cover 2 must be provided with a sufficient tolerance of strength to the vibration force. Since a fluctuating stress caused by vibration may be exerted on the contact surface 8 between the covers 2 under application of a planar pressure by the centrifugal force, fretting fatigue and abrasion at the contact edges 16 may be caused.

Since there is a tendency of increasing vibration force exerted on the cover 2 with the increased output, it is necessary to improve the resistance to fretting fatigue and abrasion at the contact edges 16 between the covers 2 caused by the vibration force. Further, if an unexpectedly large vibration force is exerted, it is necessary to provide a structure that causes a total slip at the contact surface 8 between the covers 2 to give sufficient damping effect.

Further, with increasing blade length, an increase in the amount of erosion in the steam inflow direction 4 on the steam inlet side of the steam turbine rotor blade is assumed. Therefore, it is necessary to ensure the resistance to high-cycle fatigue due to erosion.

The following introduces a steam turbine rotor blade that has solved the above-mentioned technical subjects caused by the increased length and output of the rotor blade in the low-pressure last stage of the steam turbine.

First Embodiment

An embodiment will be explained with reference to FIGS. 1A to 1D.

Figure 1A:
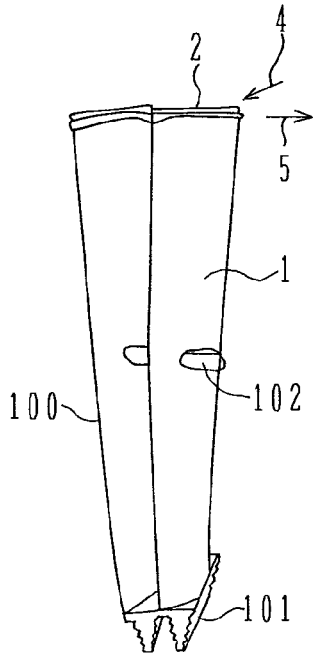
FIGS. 1A to 1D are diagrams showing an embodiment of the present invention.

As shown in FIG. 1A, a cover 2 integrally formed on a profile 1 is provided at an end of a steam turbine rotor blade (hereinafter referred to as rotor blade) 100.

An implanting portion 101 for implant the rotor blade 100 into the rotor shaft is formed at the root of the rotor blade 100. A tie-boss 102, i.e., a connecting member for circumferentially connecting a plurality of rotor blades is formed at the central portion of the profile 1.

It should be noted that, when steam flows in from a steam inflow direction 4, the rotor blade 100 rotates in a rotational direction 5.

Figure 1B:
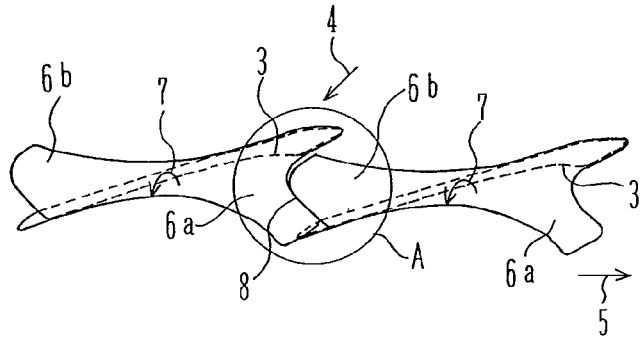

FIG. 1B is a diagram showing the cover 2 of the rotor blade 100 as viewed radially from the outer circumference side.

The cover 2 is integrally formed on the profile 1 at an end of the rotor blade 100. FIG. 1B shows a blade condition during rotation. As shown in FIG. 1B, a torsional return force 7 is exerted on the rotor blades during rotation thereby connecting the covers 2 of the adjacent two rotor blades 100 at the contact surface 8.

It should be noted that a backside canopy 6*a* of the rotor blade and a foreside canopy 6*b* of the adjacent preceding rotor blade are structured so as to be in contact and connected with each other at the contact surface 8.

Figure 1C:
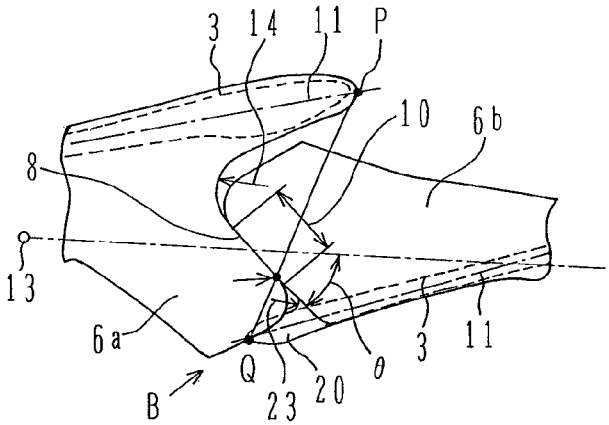

FIG. 1C is an enlarged view of a connected portion A of FIG. 1B. As shown in FIG. 1C, the steam inflow side of the contact surface 8 is connected with a smooth radius of curvature 14 in order to reduce the concentration of stress.

Figure 1D:
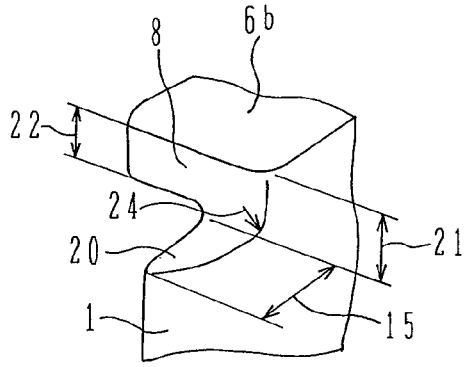

FIG. 1D is a perspective view as viewed from direction B of FIG. 1C.

The present embodiment is characterized in that a the rotor blade 100 is formed with a stepped portion 20 at the end thereof on the steam outlet side in association with the steam inflow direction 4, i.e., the steam inlet side. The stepped portion 20 formed has a height 21 larger than a cover thickness 22.

Specifically, this rotor blade 100 includes the profile 1 and the cover 2 integrally formed on and at an end of the profile 1. The leading edge of the cover 2 formed on the profile 1 and the trailing edge of the cover 2 formed on the adjacent preceding profile 1 are in contact and connected with each other by the torsional return force 7 produced during rotation. The trailing edge of the cover 2 formed on the adjacent preceding profile 1 is provided with a radially-formed stepped portion 20 having a height larger than the thickness of the cover 2.

The backside canopy 6*a* of the cover 2 of the adjacent trailing rotor blade 100 is disposed on the outer circumference side in the radial direction of the step surface of the stepped portion 20. Therefore, the canopy 6*a* overhanging the back side of the profile 1 is positioned at the stepped portion 20 formed at the trailing edge of the cover 2 formed on the adjacent preceding profile 1.

In comparison with a structure not having a stepped portion on the steam outlet side, the structure according to the present embodiment makes it possible to provide a large contact length 10 (refer to FIG. 1C) during rotation. With increasing blade length, for example, even if the cover gap 9 (refer to FIG. 2B) between the covers 2 increases with the rotor blade 100 having a length of 52 inches or more, the full circumferential connection in the rotational direction 5, i.e., circumferential direction can easily be ensured.

In order to reduce the concentration of stress, a curvature radius 24 is provided between the step surface of the stepped portion 20 and the contact surface 8 for smooth connection.

Further, as shown in FIG. 1C, a curvature radius 23 is provided so that the contact surface 8 and the profile 3 at the end of the rotor blade (on the steam outlet side) may be smoothly connected in the plane of the cover 2 as viewed radially from the outer circumference side.

With the present embodiment, the angle θ formed between the contact surface 8 between the covers 2 and the circumferential line in the circumferential direction 13 is set to 45 degrees.

This angle θ is an essential index for designing the shaped of the cover 2, and must be determined in consideration of the resistance to fretting fatigue and abrasion at the contact surface and the damping effect due to slipping at the contact surface 8.

It is desirable that the angle θ of the cover of a rotor blade in the low pressure last stage corresponding to increasing blade length and output be set to 30 to 50 degrees. Specifically, an angle formed between the contact line formed by the contact surface 8 where the adjacent two covers 2 are in contact with each other and the circumferential line in the circumferential direction 13 in which the adjacent two covers are connected be set to 30 to 50 degrees.

A relation between this angle θ, the vibration force causing a total slip at the contact surface 8, and the local stress at the contact edges 16 (refer to FIG. 2C) is calculated under the following conditions.

As far as a loading condition is concerned, after applying the torsional return force 7 by the centrifugal force, a vibration force is applied in the circumferential direction 13 as an alternate load. Then, the angle θ, the vibration force at the contact surface 8, and the local stress at the contact edges 16 are calculated. In the calculation, it is assumed that the torsional return force 7 by the centrifugal force is governed by the constitution of the rotor blade 100 and therefore is constant regardless of the angle θ at the cover 2.

With a rotor blade in the low-pressure last stage, evaluation was carried out for the vibration force in the circumferential direction 13 on an assumption that the circumferential direction 13 is the governing direction of the vibration force by the lowest order vibration mode.

Figure 3:
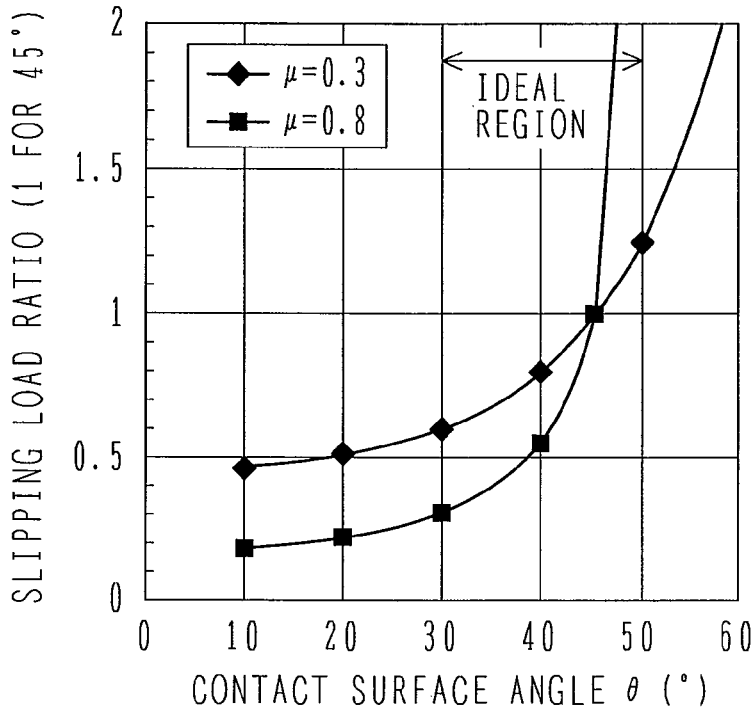
FIG. 3 is a diagram showing a relation between the contact surface angle and the slipping load ratio.

A relation between the vibration force causing a slip (slipping load ratio) at the contact surface 8 and the angle θ (contact surface angle θ) is shown in FIG. 3.

In FIG. 3, the vertical axis is standardized so that the vibration force at angle θ of 45 degrees is 1.

As shown in FIG. 3, there is a tendency of decreasing vibration force causing a slip at the contact surface 8 with decreasing angle θ. If the vibration force causing a slip decreases too much, there is a risk that a slip occurs at the contact surface 8 with a low vibration force resulting in remarkably increased rate of abrasion at the contact surface 8.

On the other hand, if the angle θ increases, the vibration force causing a slip also increases, and there arises a tendency of rapidly increasing angle θ from around 50 degrees. If the vibration force causing a slip increases too much, an unexpectedly large vibration force is exerted on the rotor blade 100, making it difficult to cause a slip at the contact surface 8. This may make it impossible to obtain a sufficient damping effect.

Specifically, it is required that a slip be not caused at the contact surface 8 with a small vibration force during normal operation and that a slip is caused at the contact surface 8 to ensure the damping effect if an unexpectedly large vibration force is exerted. In order to satisfy these characteristics, it is desirable that the angle θ be set to 30 to 50 degrees.

Figure 4:
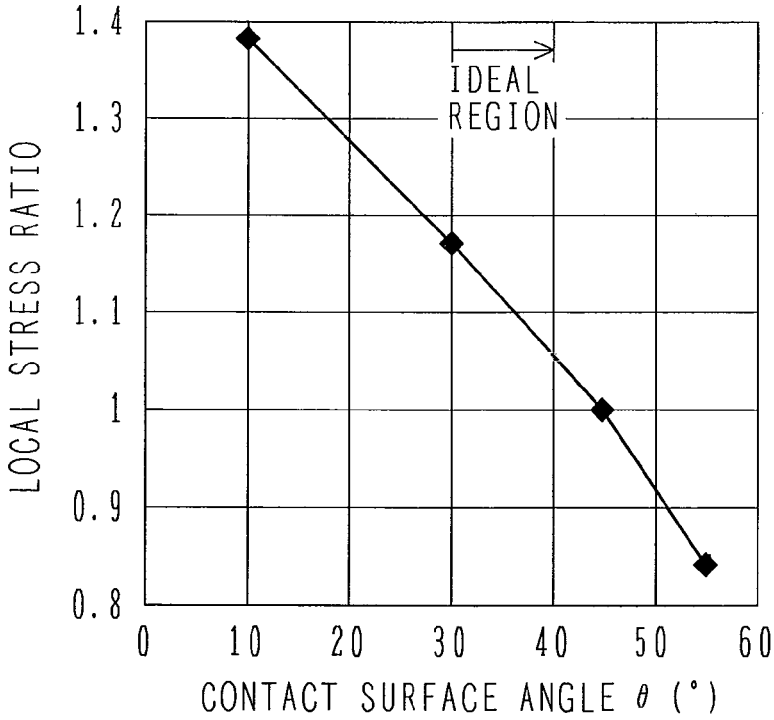
FIG. 4 is a diagram showing a relation between the contact surface angle and the local stress ratio.

FIG. 4 shows a relation between the local vibration stress (local stress ratio) at the contact edges 16 and the angle θ (contact surface angle θ).

As shown in FIG. 4, the local stress decreases with increasing angle θ, and there arises a tendency of improving the resistance to fretting fatigue at the contact edges 16. In order to ensure sufficient resistance to fretting fatigue, it is desirable that the angle θ be set to 30 degrees or more.

The angle 12 formed between the camber line 11 of the profile 3 and the circumferential direction 13 decreases with increasing blade length, as mentioned above. Accordingly, the area for forming the cover canopy 6 decreases, making it difficult to provide a sufficient contact length 10 and rigidity.

Figure 5A:
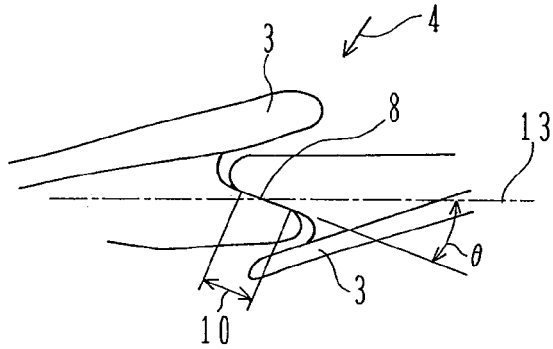
FIGS. 5A to 5D are diagrams explaining a relation between the cover shape and the cover contact length with a condition that the shape of the blade end profile is fixed, with an angle θ at which various covers are in contact with each other.
Figure 5B:
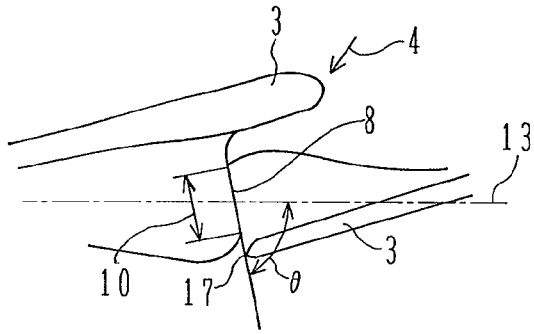

With a small angle θ (smaller than 30 degrees) or a large one (exceeding 50 degrees), the use of cover shapes respectively shown in FIGS. 5A and 5B makes it possible to provide a sufficient contact length 10 even without using a structure having the stepped portion 20 formed on the steam outlet side.

With a large angle θ (exceeding 50 degrees), a large contact length 10 can be provided by disposing a canopy from a steam outlet end 17 of the profile 3, as shown in FIG. 5B.

Figure 5C:
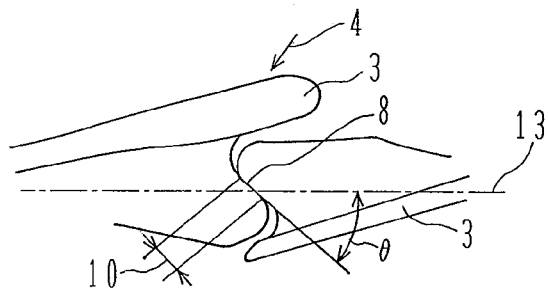

However, when setting the angle θ to 30 to 50 degrees in consideration of fretting fatigue at the contact edges 16 or the damping effect, if the stepped portion 20 is not formed on the steam outlet side like the structure according to the present embodiment, allocating a sufficient contact length 10 is liable to be difficult, as shown in FIG. 5C.

This tendency becomes more noticeable with increasing length of the rotor blade 100 and accordingly decreasing angle 12 formed between the camber line 11 of the profile 3 and the circumferential direction 13. In particular, the use of the structure according to the present embodiment is essential in the case of a long blade having a length of 45 inches or more with 3600 rpm specifications.

Figure 5D:
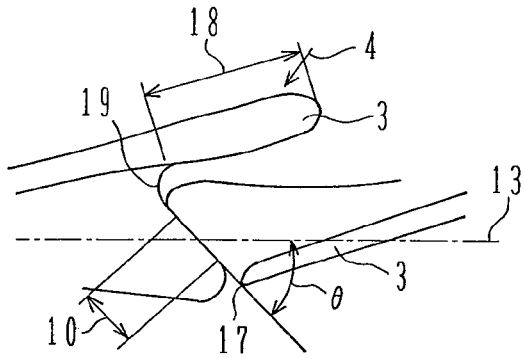

If a canopy is disposed from the steam outlet end 17 of the profile 3 according to a large angle θ (refer to FIG. 5B), a large contact length 10 can be provided as shown in FIG. 5D. However, this method is not realistic because the distance 18 from the steam inlet end of the profile 3 to a canopy root 19 increases, and there arises a problem of increasing stress concentration at the canopy root 19.

Therefore, with the cover of the rotor blade in the low-pressure last stage (rotor blade in the last stage of the low-pressure steam turbine) applicable to the increased blade length and output, it is desirable that the stepped portion 20 be formed by setting the angle θ to 30 to 50 degrees.

Further, when P denotes the intersection of the end of the steam inlet side of the profile 3 of the blade 1 and the camber line 11 thereof, Q denotes the intersection of the end of the steam outlet side of the profile 3 of the adjacent preceding blade 1 and the camber line thereof, and R denotes the intersection of a straight line connecting P and Q and the contact surface 8, as shown in FIG. 1C, the line segment ratio PR/PQ is set to 0.7 with the present embodiment.

With the structure used in the comparative example, the line segment ratio PR/PQ was about 0.5. However, with the structure according to the present embodiment where the angle θ is set to 45 degrees and the stepped portion 20 is formed on the steam outlet side, it is desirable that the line segment ratio PR/PQ be set to 0.6 to 0.8.

In order to evaluate an appropriate value of the line segment ratio PR/PQ, the following explains results of analysis of various PR/PQ values with a condition that the angle θ is fixed to 45 degrees, with reference to FIGS. 6A to 6E. When determining the line segment ratio PR/PQ, the following three points must be taken into consideration.

Firstly, it is necessary to take into consideration a vibration stress at an intersection T of the camber line 11 and an extension of the contact surface 8, at the stepped portion 20 formed on the steam outlet side.

Figure 6A:
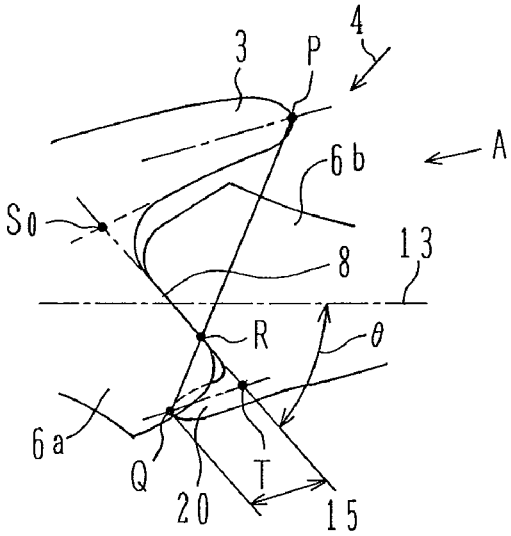
FIGS. 6A to 6E are diagrams explaining a relation between the line segment ratios PR/PQ and various evaluation items to be considered.
Figure 6B:
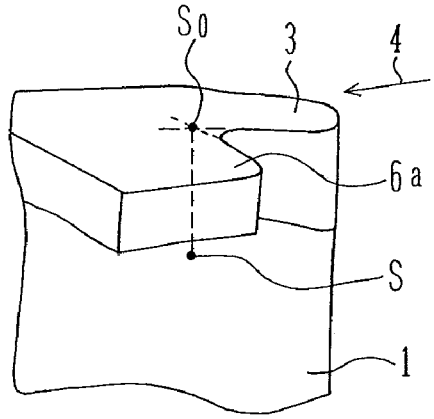
Figure 6C:
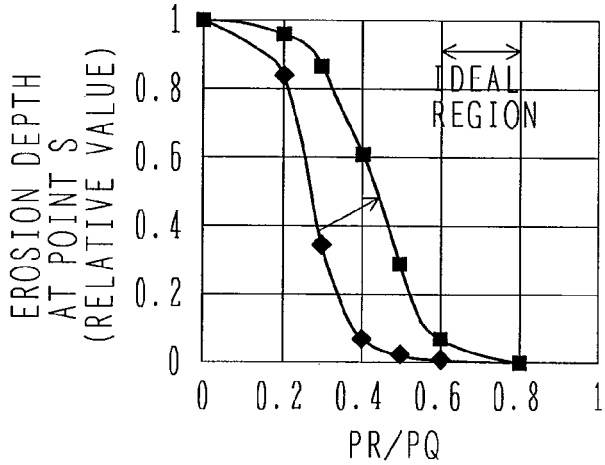
Figure 6D:
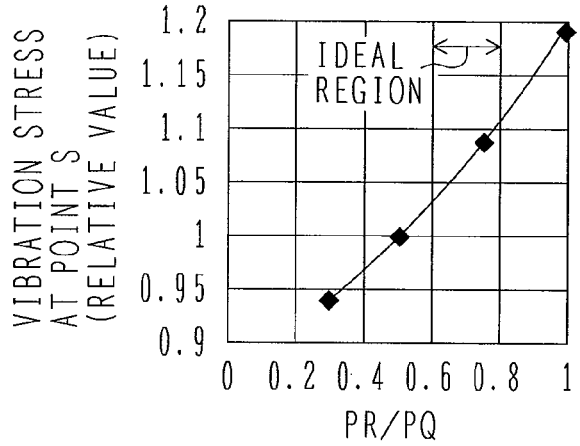
Figure 6E:
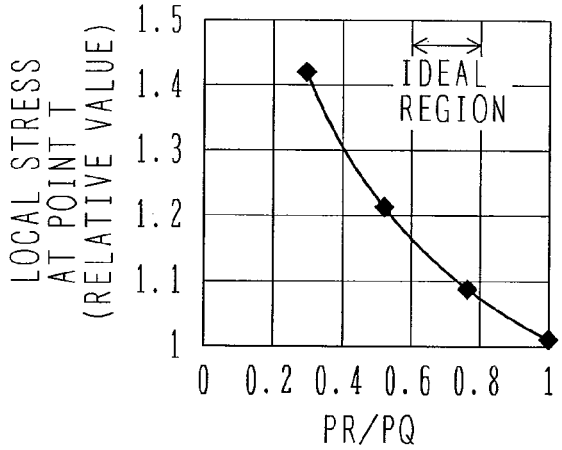

As shown in the FIG. 6E showing a relation between the line segment ratio PR/PQ and the local stress at a point T (vibration stress at the intersection T), there is a tendency of increasing local stress at the position T with decreasing line segment ratio PR/PQ. The reason is that a cutout depth 15 of the stepped portion 20 increases with decreasing line segment ratio PR/PQ. In order to prevent the increase in the local stress at the position T, it is desirable that the line segment ratio PR/PQ be set to 0.6 or more.

Secondly, it is necessary to take into consideration a vibration stress of the profile 3 located under the cover 2. When S0 denotes the intersection of the extension of the contact surface 8 between the covers 2 and the extension of the profile 3, a large vibration stress occurs at a point S, near a root of cover 2 formation, on a straight line radially drawn from S0 toward the inner circumference side, as shown in FIG. 6B.

As shown in FIG. 6D showing a relation between the line segment ratio PR/PQ and the vibration stress at the point S, the vibration stress at the point S increases with increasing line segment ratio PR/PQ; therefore it is desirable that the line segment ratio PR/PQ be set to 0.8 or less.

Thirdly, it is necessary to take into consideration the amount of erosion at the point S where a large vibration stress occurs. It is assumed that the amount of erosion by waterdrops spattering from the trailing edge of the rotor blade 100 increases at the point S.

In order to prevent the rotor blade 100 from undergoing high-cycle fatigue which may be produced by vibration with the bottom of erosion set as a reference point, it is necessary to shift the position of a portion where erosion is expected to occur from the root position of the canopy 6 formed on the cover 2. A relation between the line segment ratio PR/PQ and the relative erosion depth at the point S is shown in FIG. 6C.

The vertical axis is normalized assuming that the amount of erosion at the end (PR/PQ is 0) on the steam inlet side is 1.

Since the circumferential velocity at the end of the rotor blade increases with increasing blade length, an area which may be subjected to large erosion tends to increase. In order to shift the position of an area where a large amount of erosion is expected from that of a point S where a large vibration stress occurs, it is desirable that PR/PQ be set to 0.6 or more.

Therefore, when P denotes the intersection of the end of the cover 2 at the leading edge of the profile 1 and the camber line 11 thereof, Q denotes the intersection of the end of the profile 1 at the trailing edge of the adjacent preceding profile 1 and the camber line 11 thereof, and R denotes the intersection of a straight line connecting P and Q and the contact line, it is desirable that the ratio of line segment distance (line segment ratio) PR/PQ be set to 0.6 to 0.8.

Thus, by providing a stepped portion radially formed on the steam outlet side at an end of the steam turbine rotor blade and disposing a cover canopy of the adjacent trailing rotor blade on the outer circumference side in the radial direction of the step surface of the stepped portion, a large contact length can be provided for the cover. Further, even if expected variation in cover gap increases with increasing blade length, the full circumferential connection can easily be ensured.

Further, by setting the angle formed between the cover contact surface and the circumferential direction to 30 to 50 degrees, the resistance to fretting fatigue and abrasion at the contact edge can be improved. Further, even if excessive vibration force is exerted, a total slip can be caused at the cover contact surface to improve the damping effect.

Further, when P denotes the intersection of the end on the steam inlet side of the rotor blade and the camber line thereof, Q denotes the intersection of the end on the steam outlet side of the adjacent preceding rotor blade and the camber line thereof, and R denotes the intersection of a straight line connecting P and Q and the contact surface, the stress concentration at the stepped portion on the steam outlet side can be reduced by setting the line segment distance ratio PR/PQ to 0.6 to 0.8. Further, the resistance to high-cycle fatigue can be improved by shifting the position where a large vibration stress occurs from that of a portion where erosion is expected to occur.

The present invention relates to a steam turbine rotor blade in which blades are connected with one another by covers formed at respective ends thereof, and is applicable to a steam turbine using such steam turbine rotor blades and further to a steam turbine plant.

What is claimed is:

1. A steam turbine rotor blade comprising:

a blade portion having a length of 48 inches or more;

a cover integrally formed on and at an end of the blade portion, the cover having a backside canopy extending from the backside of the blade portion and a foreside canopy extending from the foreside of the blade portion, the backside canopy being formed at the leading edge side of the cover and the foreside canopy being formed at the trailing edge side thereof; and a radially-formed stepped portion provided at the trailing edge side of the cover, the stepped portion having a height larger than the thickness of the cover;

wherein the backside canopy has a surface in contact with a foreside canopy on an adjacent preceding blade, the backside canopy and the foreside canopy on the adjacent preceding blade being connected with each other through the contact surface by the torsional return force produced during rotation;

wherein the backside canopy has a curved surface connecting the steam inflow side of the contact surface to a profile at the end of the blade portion, as viewed radially from the outer circumference side of the turbine;

wherein the backside canopy is positioned at a stepped portion formed at the trailing edge of a cover formed on the adjacent preceding blade;

wherein an angle formed between a contact line formed by the contact surface where adjacent two covers are in contact with each other and a circumferential line along which the adjacent two covers are connected is 30 to 50 degrees; and wherein, when P denotes the intersection of the end of the leading edge of the cover formed on the blade portion and the camber line thereof, Q denotes the intersection of the end of the trailing edge of the cover formed on the adjacent preceding blade and the camber line thereof, and R denotes the intersection of a straight line connecting P and Q and the contact line, a line segment ratio PR/PQ is 0.6 to 0.8.

2. The steam turbine rotor blade according to claim 1, wherein the blade portion is used for a last stage of a low-pressure steam turbine.

* * * * *